United States Patent [19]

Patil et al.

[11] 4,138,314

[45] Feb. 6, 1979

[54] METHOD OF FORMING DIAPHRAGMS FROM DISCRETE THERMOPLASTIC FIBERS REQUIRING NO BONDING OR CEMENTING

[75] Inventors: Arvind S. Patil, Grosse Ile; Eugene Y. Weissman, Birmingham, both of Mich.

[73] Assignee: BASF Wyandotte Corporation, Wyandotte, Mich.

[21] Appl. No.: 812,684

[22] Filed: Jul. 5, 1977

Related U.S. Application Data

[62] Division of Ser. No. 566,911, Apr. 10, 1975, Pat. No. 4,036,729.

[51] Int. Cl.[2] ..... C25B 13/08

[52] U.S. Cl. ..... 162/102; 162/106; 162/157 R; 162/158

[58] Field of Search ..... 162/105, 155, 157 R, 162/102, 158, 106; 204/295, 296; 264/127

[56] References Cited

U.S. PATENT DOCUMENTS

| | | | |
|---|---|---|---|
| 3,235,636 | 2/1966 | Trimble | 264/127 |
| 3,928,166 | 12/1975 | O'Leary | 204/296 |
| 3,945,910 | 3/1976 | DeCeuster et al. | 204/296 |
| 3,980,613 | 9/1976 | Bachot et al. | 204/296 |

*Primary Examiner*—S. Leon Bashore
*Assistant Examiner*—William F. Smith
*Attorney, Agent, or Firm*—Bernhard R. Swick; Arnold S. Weintraub; Robert E. Dunn

[57] ABSTRACT

Diaphragms for electrolytic cells are prepared by depositing onto a cathode screen, discrete thermoplastic fibers. The fibers are highly branched, and which, when deposited form an entanglement or network thereof, which does not require bonding or cementing.

4 Claims, No Drawings

METHOD OF FORMING DIAPHRAGMS FROM DISCRETE THERMOPLASTIC FIBERS REQUIRING NO BONDING OR CEMENTING

This is a divisional application of copending U.S. patent application Ser. No. 566,911, filed Apr. 10, 1975.

BACKGROUND OF THE INVENTION

1. Field of the Invention

The present invention relates to diaphragms for electrolytic cells. More particularly, the present invention relates to diaphragms for electrolytic chlor-alkali cells. Even more particularly, the present invention relates to diaphragms from thermoplastic fibers for use in electrolytic chlor-alkali cells.

2. Prior Art

Asbestos fibers have long been employed as the conventional material for use as diaphragms in chlor-alkali electrolytic cells. Because of the continuous dissolution of asbestos in the cell liquor, asbestos diaphragms have a limited useful life. Furthermore, as is known to those skilled in the art, asbestos diaphragms evidence swelling, thereby necessitating compensating the distance between the diaphragm and the cathode to accommodate this swelling phenomenon. Moreover, asbestos has a high electrical resistance, thus, reducing cell efficiency. Therefore, the prior art has sought suitable requirements for asbestos as the fibrous material for diaphragms.

In seeking suitable replacements for asbestos in electrolytic cells, the prior art has directed its attention to thermoplastic fibers. Thermoplastic fibers maintain diaphragm continuity in the presence of gaseous turbulence within the cell. Generally, the thermoplastic fibers taught as replacements for asbestos have been fluorinated hydrocarbons, such as polytetrafluoroethylene. See, inter alia, U.S. Pat. Nos. 3,312,614 and 3,702,267. Other thermoplastic compounds taught heretofore include the polyalkylene resins, such as polyethylene and polypropylene. See, inter alia, U.S. Pat. No. 3,775,272.

However, in deploying such materials, the fibers are, generally, produced by either a melt spinning or a melt blowing process, such as described in U.S. Pat. No. 3,755,527. Although these fibers are eminently useful as replacements for asbestos, it is necessary to either cement the fibers to each other or self-bond the fibers, prior to installation in an electrolytic cell. This is an additional preparatory step which increases the cost of manufacture of such diaphragms.

Other prior art teaches the use of waterleaf rubber diaphragms. However, such materials cannot be used in chlor-alkali cells.

Thus, a major advancement in the art would be provided if thermoplastic fibers, requiring no cementing or bonding, could be employed as diaphragms for electrolytic cells, and especially, in chlor-alkali cells.

SUMMARY OF THE INVENTION

In accordance with the present invention, discrete thermoplastic fibers are produced by a process which provides highly branched fibers. The so-produced highly branched fibers are deposited on a cathode screen or the like and, are, then, deployed as diaphragms.

The highly branched fibers, when deposited, provide an entanglement or network of fibers which do not require cementing or bonding prior to deployment.

The highly branched fibers can be produced in accordance with the process described in Belgian Pat. No. 795,724, or any other process which produces highly branched fibers.

The preferred thermoplastic materials employed herein are the fluorohydrocarbon fibers. The present invention also, provides an improved mode of dispersing fluorohydrocarbon fibers preparatory to depositing the fibers on the cathode screen.

For a more complete understanding of the present invention reference is made to the following detailed decription and accompanying examples.

DESCRIPTION OF THE PREFERRED EMBODIMENTS

As hereinbefore noted, the present invention contemplates the formation of a diaphragm, for use in an electrolytic cell, and in particular, a chlor-alkali cell, from highly branched thermoplastic fibers.

By utilizing highly branched thermoplastic fibers, it has been found that the necessity for cementing or bonding the fibers to each other is eliminated. The branched fibers form an entanglement or network of intermeshed fibers which are inter-entangled to a degree such that the same effect as accompanies cementing or bonding is realized.

In practicing the present invention, any branched thermoplastic fiber capable of withstanding the internal conditions of a chlor-alkali cell can be utilized herein. Such thermoplastic fibers, in order to be efficacious, must exhibit resistance to chemical degradation, low electrical resistance and adequate hydraulic permeability. Thus, suitable thermoplastic fibers contemplated herein include polyolefins, polycarbonates, polyesters, polyamides, and the like, as well as mixtures thereof. Representative of these types of compounds are, for example, polyethylene, polypropylene, hexamethylene adipamide and other nylons, polyethylene terephthalate, poly-4-methylpentene-1, poly(tetramethylene) terephthalate, polystyrene-polyvinylidene copolymers, polycarbonates of 2-(4-hydroxymethyl) propane (Bisphenol A), polyphenylene oxide and the like, as well as mixtures thereof. Also, polyarylsulfones can be utilized herein.

A particularly preferred class of thermoplastic fibers contemplated for use herein is the fluorinated hydrocarbons, and in particular, fluorinated polyalkylenes. The fluorinated polyalkylenes can be additionally halogen-substituted fluorinated polyalkylenes. Representative of the fluorinated hydrocarbons are, for example, polytetrafluoroethylene, fluorinated ethylene-propylene copolymers, polychlorotrifluoroethylene, chlorotrifluoroethylene, polyvinylidenefluoride, polyethylenechlorotrifluoroethylene, polyethylenetetrafluoroethylene and tetrafluoroethyleneperfluorovinylether sulfonyl fluoride copolymers. Additionally, blends of fluorohydrocarbons with any of the herein-before enumerated thermoplastic fibers can be utilized herein.

It is also possible to use other highly branched, non-polymeric fibers, in admixture with the polymeric fibers thereof. Thus, minor amounts of asbestos fibers and the like can be used in admixture with the highly branched fibers hereof.

As noted hereinbefore, conventional melt spinning and blowing processes do not produce the branched fibers hereof. Rather, in order to produce the branched fibers hereof, a process such as that described in Belgian Pat. No. 795,724, the disclosure of which is hereby incorporated by reference, is employed.

Generally speaking, the process disclosed therein comprises extruding a polymer melt from a spinneret in the presence of an auxiliary liquid medium. The auxiliary liquid medium applied a shear force to the formed fibers or fibrids as the melt is discharged from the spinneret orifices. The melt is, thus, caused to fragment in a zone of high energy loss. This results in the formation of fibers having pre-determined exact dimensions in a single step. According to the reference, the fibrids thereof have a length of about one hundred times the diameter.

It is to be understood that other melt solution or solution spinning process which form highly branched fibers can be equally utilized herein. The only criticality attached hereto is that highly branched fibers be utilized.

By the process thereof, and as disclosed therein fibrids can be produced which have a structure resembling natural fibers, including ends which interlink the different element i.e. branched fibers.

The fibers utilized in accordance herewith, as noted, are highly branched and have a fiber diameter of from about 0.1 to about 40 microns, and are, preferably, less than one micron. The efficacy of the use of fibers in diaphragms having such minute diameters is disclosed in copending U.S. patent application Ser. No. 548,684, entitled "Thermoplastic Fibers as Separator or Diaphragm in Electrochemical Cells", and filed on Feb. 10, 1975.

As is known to those skilled in the art, fluorinated hydrocarbon fibers, per se, are difficult to disperse in an aqueous medium, thereby, rendering such fibers difficult to deposit on a cathode screen or support. To alleviate this situation, the present invention, also, includes an improved method of dispersing fluorinated hydrocarbon fibers.

It has now been found that if the fibers are dispersed in an aqueous-acetone medium, and in the presence of a surfactant, to form a slurry, the problems of dispersing the fibers are overcome.

The aqueous-acetone medium is generally prepared by mixing the water and acetone together in a volumetric ratio of from about 0.5:1 to about 1:0.5. Preferably, a 1:1 volumetric ratio of water to acetone is employed.

The surfactant is employed in an amount ranging from about 0.01% to about 10%, by weight, based on the weight of the slurry.

Useful surfactants include both organic and inorganic wetting agents. Suitable organic wetting agents or surfactants are the nonionic and anionic surfactants.

Useful nonionic surfactants include the oxyalkylene condensates of ethylene diamine, such as the ethylene oxide-propylene oxide block copolymers prepared by the sequential addition thereof to ethylene diamine, and as described in U.S. Pat. No. 2,979,528. Other useful organic surfactants include polyoxyethylene alkylphenols, polyoxyethylene alcohols, polyoxyethylene esters of fatty acids, polyoxyethylene mercaptans, polyoxyethylene alkylamines, polyoxyethylene alkylamides, polyol surfactants, and the like.

Suitable inorganic wetting agents which can be internally incorporated into the fibers include, for example, asbestos; mica; titanates, such as barium titanate, and potassium titanate; talc, verniculite, titanium dioxide, boron nitrides, kaolinite, diatomaceous earth and clays, as well as mixtures thereof.

In the practice of the present invention, the preferred surfactants are the perfluorinated fatty acids, alcohols or sulfonate-based surfactants. These surfactants are widely known and commercially available. They are sold under a plurality of trademarks, such as FLUORAD FC-126 or FC-170; and Zonyl FSM, FSA or FSP.

The branched fibers hereof are dispersed in the surfactant-containing aqueous-acetone medium in an amount ranging from about one to fifteen percent, by weight, based on the total weight, to form a slurry thereof.

The slurry is then vacuum deposited on a cathode screen by any suitable method. A particularly preferred method of depositing the slurry contemplates the immersion of the cathode screen, mounted in a vacuum box, into the slurry which is maintained in a state of agitation. Then, a series of increasing partial vacuums are applied across the screen for a period of time, followed by a full vacuum for a pre-determined period of time. The screen having the fibers deposited thereon is, then, dried at a temperature of about 100° C. for about one to three hours to evaporate the water.

The so-formed diaphragm comprises, as noted, an entanglement of fibers which does not require self-bonding or cementing.

It should be noted that with respect to the present invention, the use of the type of process described in the above-referred to Belgian Patent is critical hereto. Although the use of this process for forming thermoplastic fibers has heretofore been described in the above-referred to copending U.S. patent application, it was not known until now that the highly branched fibers produced thereby could be deployed directly as a diaphragm without the need for bonding or cementing the fibers.

Following is a specific, non-limiting example illustrating the principles of the present invention.

EXAMPLE

Into a 1:1 water-acetone medium containing 0.1%, by weight of a fluorocarbon surfactant sold commercially under the name FLUORAD FC-126 was added six percent, by weight, of polyvinylidenefluoride fibers. The fibers were produced by the process described in Belgian Patent No. 795,724. The fibers were mixed and dispersed in the medium to form a slurry thereof.

While maintaining the slurry in a state of agitation, a cathode screen, mounted in a vacuum box, was submerged in the slurry. A partial vacuum of 1" of Hg was applied to the box for three minutes. Then, the vacuum was increased to 3" of Hg and was applied to the box for three minutes. While still maintaining the slurry in a state of agitation, a full vacuum was then applied to the box for five minutes.

The so-deposited diaphragm on the cathode screen was then dried in an oven for two hours at 100° C.

The diaphragm was then mounted in a test chlor-alkali cell and subjected to brine electrolysis. The cell with the diaphragm mounted therein produced ninety-eight grams per liter of caustic at 81% current efficiency, thus, establishing the efficacy of the present invention.

Having, thus, described the invention what is claimed is:

1. In a method for manufacturing a diaphragm for use in an electrolytic cell of the type comprising depositing a fiber onto an electrolytic cathode screen, the improvement comprising:

(a) dispersing a slurry consisting essentially of highly branched thermoplastic fibers in a water-acetone medium containing a surfactant to form a slurry thereof said slurry being free of bonding or cementing agents, (b) depositing the slurry onto a cathode screen to form a diaphragm of entangled highly branched thermoplastic fibers thereon, (c) drying the deposited diaphragm.

2. The improvement of claim 1 wherein the water and acetone are present in a respective, volumetric ratio ranging from about 0.5:1 to about 1:0.5.

3. The improvement of claim 1 wherein the surfactant is present in an amount ranging from about 0.01% to about 10% by weight, based on the weight of the slurry.

4. The improvement of claim 1 wherein the thermoplastic fiber is a fluorinated hydrocarbon and the surfactant is a fluorocarbon surfactant.

* * * * *